US005680009A

United States Patent [19]

Krinke et al.

[11] Patent Number: 5,680,009

[45] Date of Patent: Oct. 21, 1997

[54] METHOD OF MAKING AN ELECTRIC INCANDESCENT LAMP, AND ELECTRIC LAMP MADE IN ACCORDANCE WITH THE METHOD

[75] Inventors: Andreas Krinke, Ingolstadt; Herbert Kugler, Rennertshofen, both of Germany

[73] Assignee: Patent-Treuhand-Gesellschaft fuer elektrische Gluehlampen mbH, Munich, Germany

[21] Appl. No.: 668,435

[22] Filed: Jun. 17, 1996

[30] Foreign Application Priority Data

Jun. 29, 1995 [DE] Germany ..... 195 23 146.5

[51] Int. Cl.[6] ..... H01K 1/14; H01K 3/06

[52] U.S. Cl. ..... 313/578; 313/269; 313/273; 313/275; 313/276; 313/278; 313/279; 445/4; 445/32

[58] Field of Search ..... 313/578, 273, 313/274, 275, 276, 278, 279, 315, 316, 269; 445/4, 32

[56] References Cited

U.S. PATENT DOCUMENTS

| | | | |
|---|---|---|---|
| 3,555,338 | 1/1971 | Scoledge | 313/273 X |
| 3,870,920 | 3/1975 | De Fraeye et al. | 313/273 X |
| 3,909,653 | 9/1975 | Bottone et al. | 313/277 X |
| 3,986,067 | 10/1976 | De Fraeye | 313/273 |
| 4,023,060 | 5/1977 | Pike et al. | 313/273 |
| 4,145,630 | 3/1979 | DeCaro et al. | 313/273 |
| 4,578,616 | 3/1986 | Cardwell | 313/579 |
| 4,720,653 | 1/1988 | Buschmann et al. | 313/273 X |

FOREIGN PATENT DOCUMENTS 31 36 961 3/1983 Germany .

*Primary Examiner*—Ashok Patel

*Attorney, Agent, or Firm*—Frishauf, Holtz, Goodman, Langer & Chick, P.C.

[57] ABSTRACT

To permit easy assembly of a filament for a halogen incandescent lamp having a filament holder frame (4) to retain an essentially planar filament (11) in position, the frame is made of two pre-manufactured identical frame halves (4a, 4b). Both frame halves have a cross element (7a, 7b), having a plurality of filament holders (10a, 10b) secured thereto, and two support strut portions (8a, 9a, 8b, 9b) at the ends thereof. To assemble the lamp, the two frame halves, together with the filament (11), are placed in a suitable jig, and the filament ends are threaded on one of the support strut portions (8a, 8b) of each one of the frame halves. The filament (11) is hooked on the filament holder (10a, 10b) and, by spreading apart the frame halves, the filament is stretched. The support strut portions (8a, 8b; 9a, 9b) are then connected by welding, thus completing the frame (4), and retaining the filament in stretched position. This permits mechanized assembly of the filament (11) in the frame (4) and, hence, inexpensive manufacture; separating the welding steps of the frame from filament connection reduces oxidation on part of the filament.

13 Claims, 3 Drawing Sheets

METHOD OF MAKING AN ELECTRIC INCANDESCENT LAMP, AND ELECTRIC LAMP MADE IN ACCORDANCE WITH THE METHOD

Reference to related patent, the disclosure of which is hereby incorporated by reference: U.S. Pat. No. 4,578,616, Cardwell.

FIELD OF THE INVENTION

The present invention relates to a method to make an electric incandescent lamp, and more particularly to the frame structure for the filament of an incandescent lamp, and a method of making the frame structure for ease of assembly in the lamp.

BACKGROUND

A halogen incandescent lamp with a coiled filament forming a planar light source is described in U.S. Pat. No. 4,578,616, Cardwell, the disclosure of which is hereby incorporated by reference. The essentially planar light source is secured within the lamp bulb by a support frame. The support frame, essentially, is formed by two rod or strip-like bridge elements, for example of quartz glass, which are spaced from each other. They are connected by support struts, melt-sealed in the cross bridges. The ends of the coiled filament are threaded on the support struts. Uncoiled filament portions are hooked into hook-like filament holders, secured to the rod or strip-like cross elements.

Retaining the incandescent filament, in accordance with this disclosure, requires that the ends of the filament must be threaded on the support struts before the support struts can be melt-connected or melt-sealed in the cross rods or strips or bridge elements. Making the filament frame in this manner has a disadvantage in that the filament is highly heated as the support struts are melt-sealed in the quartz-glass bridge elements. As a result, the ends of the filaments may be subjected to undesired oxidation. The cross bridge elements, of quartz glass, must be heated in this manufacturing step to a temperature of over 2000° C. Oxidation of the filament may result, leading in operation of the lamp to coatings on the lamp bulb, and to reduction of the lifetime of the lamp.

THE INVENTION

It is an object to provide a method to make an electric incandescent lamp in which the assembly of the filament within the lamp is improved, and which eliminates the disadvantages of the prior art, and to provide an incandescent lamp which has an improved lifetime with reduced coating of the lamp bulb with filament material.

Briefly, two essentially identical frame halves are provided, in which each frame half includes a rod or strip-like cross element. Two support strut portions are secured to the respective cross elements leaving free ends thereof. At least one filament holder is secured to the respective cross element. The preassembled frame halves, which include the cross elements, are located in a jig and are so positioned that they are essentially parallel to each other, with the free ends of the support strut portions of the frame halves facing each other, and separated by a predetermined spacing distance. One end of the coiled filament is stranded on a free end of one of the strut portions and then the other end of the coiled filament is threaded on the free end of one of the support strut portions of the other one of the frame halves. Intermediate portions of the coiled filament are then attached to the holders, previously secured to the cross elements. The spacing between the frame halves is then increased, thereby stretching the coiled portions of the filament between the halves, and then the halves are securely connected together by connecting the support strut portions of the first frame half to the support strut portions of the second frame half, for example by welding. The ends of the filaments are also attached to the support struts, which are then mounted in the lamp in the usual manner.

The method is characterized by a substantially improved mounting of the coiled filament. The frame-like portion, in which the filament is held, due to the two halves which, preferably, are essentially identical, permits pre-manufacturing of the frame halves.

These pre-manufactured frame halves, together with the coiled filament, are placed in a suitable jig where the filament is attached to the frame halves. By constructing the frame of two essentially identical halves, completely mechanized manufacture of the frame halves, and then of the frame, when the halves are connected together, is possible. This substantially simplifies securing the filament in the frame, and thus substantially reduces manufacturing costs. Manufacturing the frame halves in separate working steps before attaching the filaments thereto has the advantage that the filament, during the manufacture of the frame, and particularly while the support struts are melt-sealed into the cross elements, or cross rods or strips, can be done before the filament is attached thereto, so that the filament is not subjected to high thermal loading, which might cause oxidation thereof.

In accordance with a feature of the invention, the cross strips or cross elements are made of electrically insulating material, preferably quartz glass, to which filament holders in form of support hooks are secured, for example by being melted into the quartz glass-cross element. The support struts are made of a high heat-resistant, high temperature melting metal. The support struts of each of the two frame halves, preferably, are of different lengths, and are melted into the respective cross element, or cross strip or cross rod. The coiled ends of the filament are preferably secured to the longer ones of the support struts of the halves. To connect the two halves together, the free ends of the long struts of the halves are secured to the free ends of the short struts, preferably by welding. This ensures that the ends of the filament coil are attached outside of the interconnection of the support struts. Securing of the filament ends to the support struts does not damage the inter-connection of the support struts. Preferably, the free ends of the support struts which, for example, are of circular cross section, are flattened or formed with flat or plane surfaces at their ends, where they are to be welded together.

DRAWINGS

DETAILED DESCRIPTION

Figure 4:
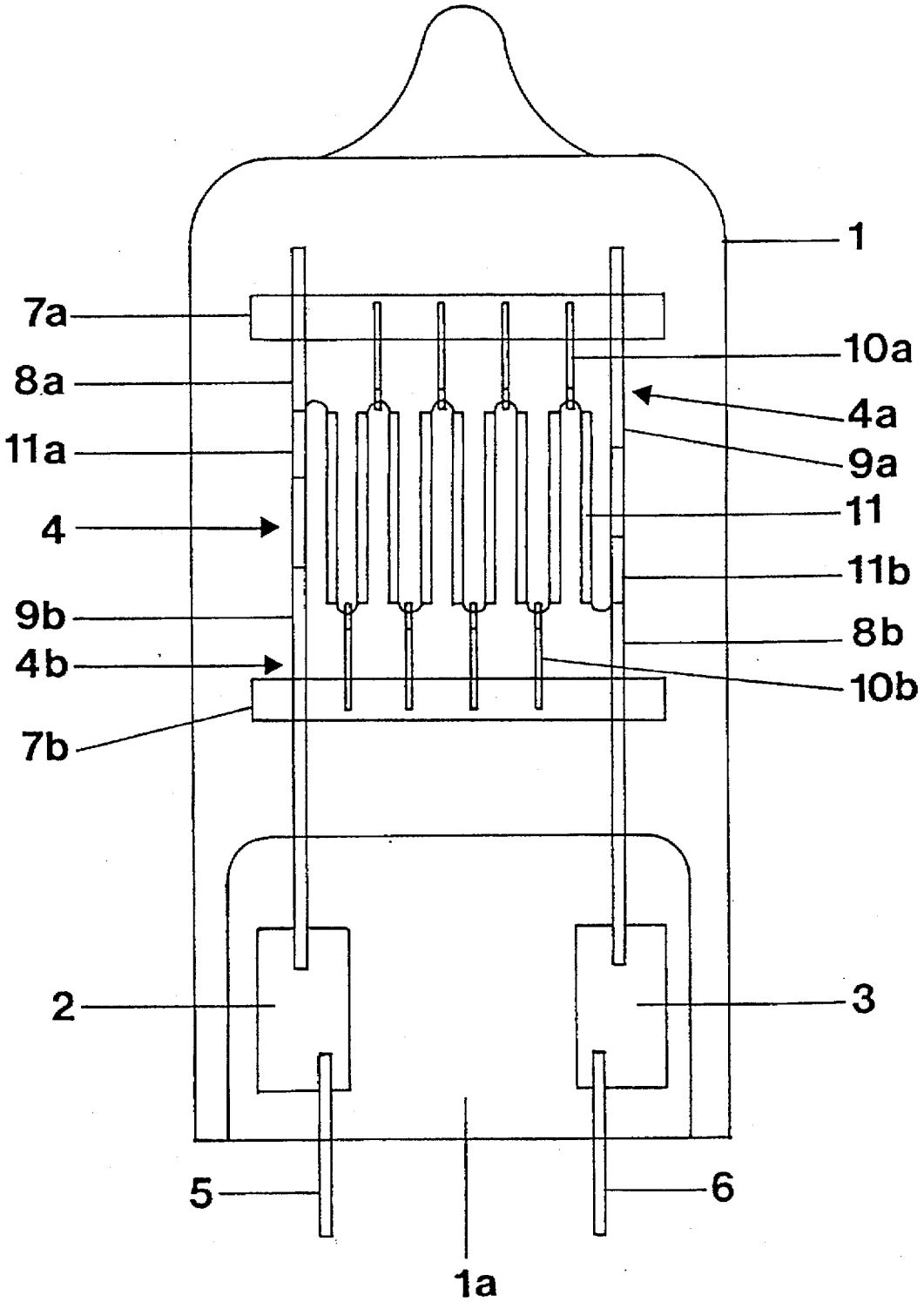
FIG. 4 is a highly schematic front view of an electric incandescent lamp made in accordance with the method of the present invention, omitting, however, a base for the lamp.

The method of the present invention is particularly suitable for an electric incandescent lamp having a planar filament system, secured in a frame filament mount. Incandescent lamps of this type are used, for example, in optical apparatus, typically for optical imaging in projectors or the like. Referring to FIG. 4: the lamp, there illustrated, is a halogen incandescent lamp suitable for a network voltage of about 230 V, and having a power rating of about 500 W. This lamp has a gas tightly closed lamp bulb 1 made of quartz glass, which is terminated at one end by a pinch seal bottom 1*a*. The pinch seal bottom 1*a* retains two molybdenum foils 2, 3, which are gas tightly melt-sealed therein. The molybdenum foils 2, 3 are electrically conductively connected with a frame located within the lamp bulb 1, which is provided to hold the planar coil filament 11 and provide for electrical connection thereto. The molybdenum foils 2, 3 are also connected to externally projecting connecting leads 5, 6 which are suitable for connection to a standard lamp base, not shown. After securing the bulb of FIG. 4 in a suitable base, the pinch seal bottom 1*a* is located therein. The base, of course, is formed with the usual connecting terminals, for coupling to a suitable lamp socket.

In accordance with a feature of the present invention, the frame 4 forming the support for the filament 11 is made of two pre-manufactured identical halves 4*a*, 4*b*. The first, or top frame half 4*a* includes a cross rib or cross element 7*a* made of quartz glass. A long support strut 8*a* and a short support strut 9*a* are melt-sealed into the cross element 4*a*. The support struts 8*a*, 9*a* are made of molybdenum. Additionally, four hook-like filament holders 10*a*, also of molybdenum, are secured, by melt-sealing, to the cross element 4*a*.

The second, or bottom frame half 4*b* is, preferably, identical to the first frame half, but secured within the lamp in mirror image with respect thereto. It, also, has a cross element 7*b*, a long support strut 8*b* and a short support strut 9*b*, all of molybdenum, as well as four hook-like holder elements 10*b*, all melt-connected in the cross element 7*b*. The filament 11 is arranged in meander form, and has a plurality of single coiled portions which are separated from each other by uncoiled portions. The uncoiled portions of the filament 11 are hooked into the holders 10*a*, 10*b*, as shown in FIG. 4. The filament 11 is secured on and electrically connected to the long support struts 8*a*, 8*b* with its singly coiled ends.

Figure 1:
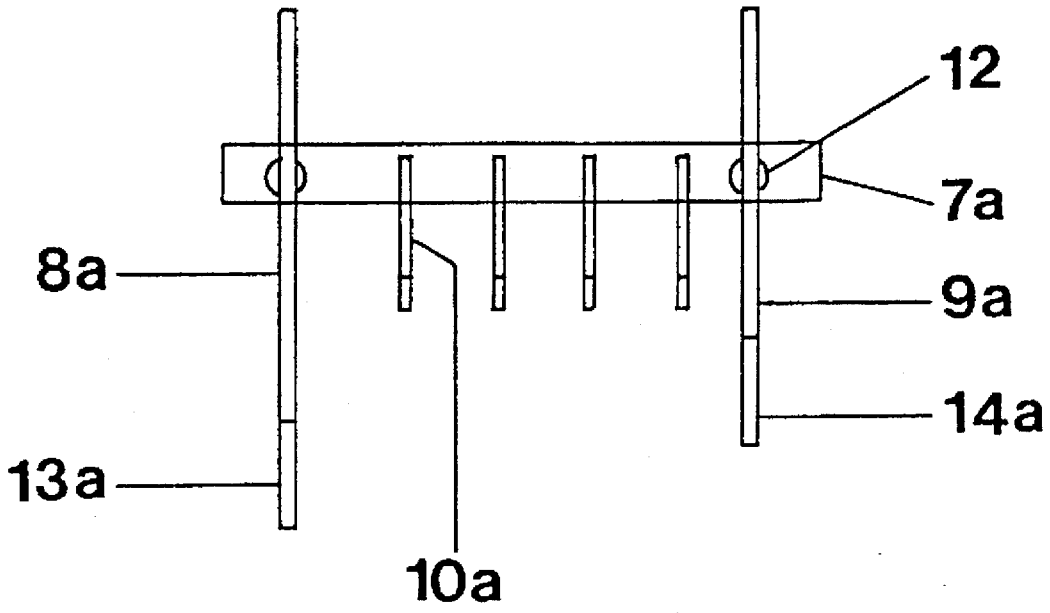
FIG. 1 is a front view of a frame half, in accordance with a preferred embodiment of the invention.
Figure 2:
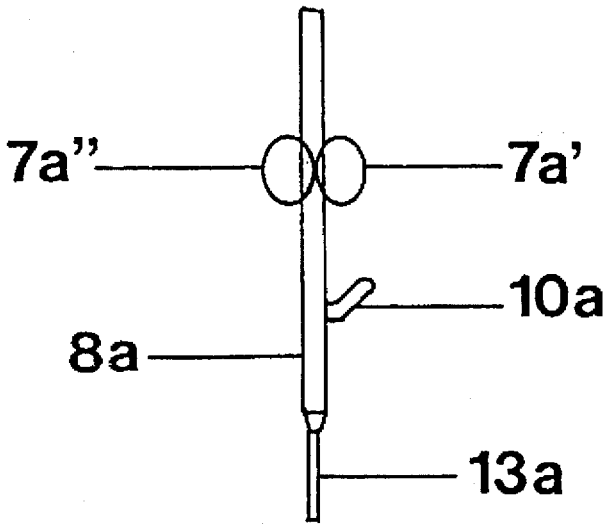
FIG. 2 is a side view of the frame half shown in FIG. 1.
Figure 3:
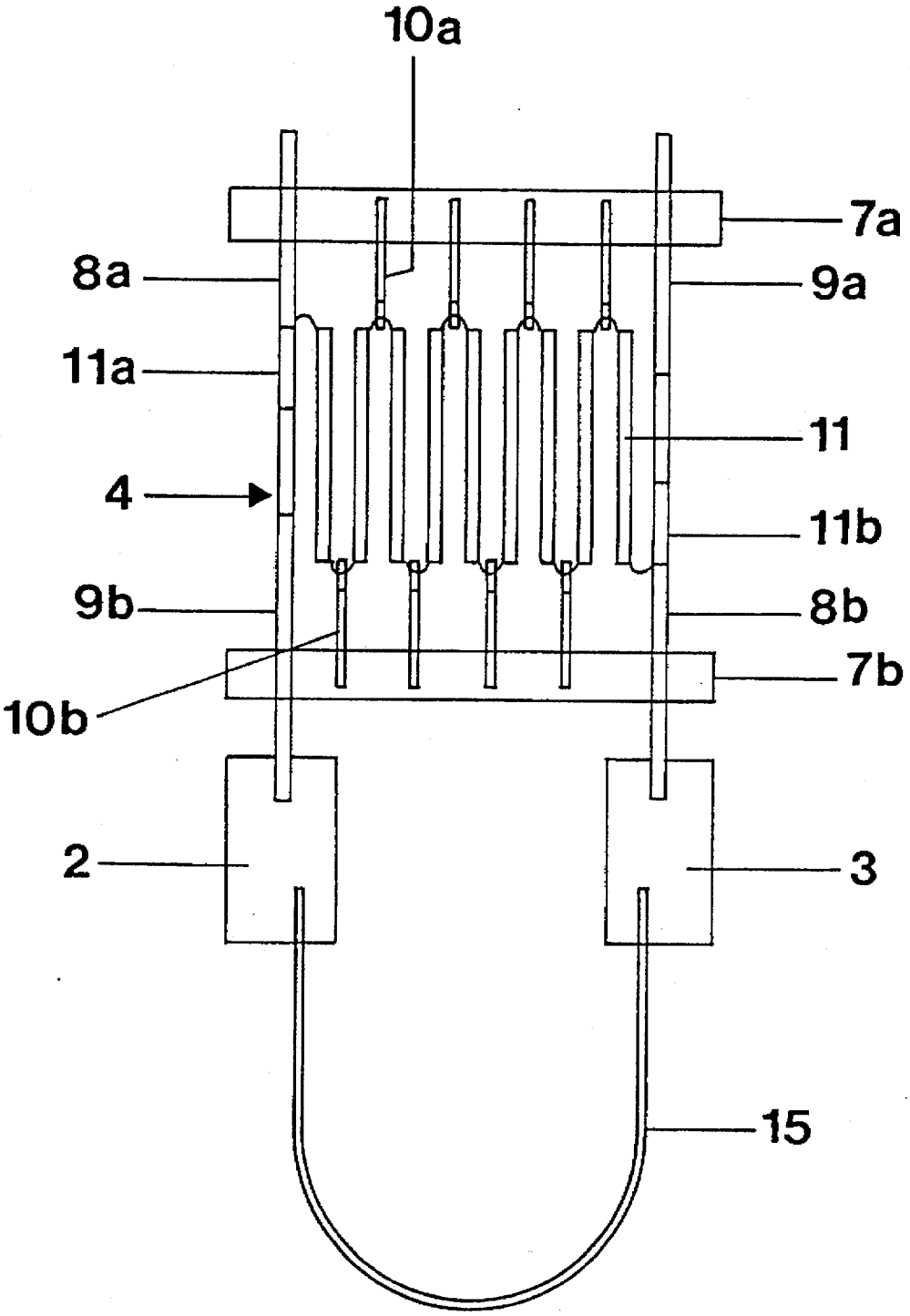
FIG. 3 is a top view of a complete frame, after connection of the filament, and also showing current supply elements ready to be melt-sealed.

Method of Making the Lamp, with Reference to FIGS. 1–3

The present invention is specifically directed to securing the filament 11 in the lamp. Manufacturing steps which are not concerned with mounting of the filament are well known to those skilled in the art and are described only briefly and when they are in connection with attachment and mounting of the filament, or are needed for an understanding of the present invention. Generally conventional lamp manufacturing steps are omitted.

First, two identical halves 4*a*, 4*b* for the frame-type filament mount are made. The construction of these halves is best seen in the schematic illustrations of FIGS. 1 and 2. The top frame half 4*a* has a cross element 7*a* of quartz glass into which a long strut portion 8*a* and a short strut portion 9*a*, both of molybdenum, is melt-sealed; four hook-shaped filament holders 10*a*, likewise of molybdenum, are melt-sealed in the cross element 7*a*. The four holders 10*a* are equidistantly located, spaced from each other, between the support strut portions 8*a*, 9*a*. The spacing of the long strut 8*a* to the next adjacent holder 10*a* is larger than the spacing of the short strut 9*a* to the next adjacent holder 10*a*, see FIG. 1. The free ends 13*a*, 14*a* of the support struts 8*a*, 9*a* are flattened. The struts 8*a*, 9*a* and the filament holders 10*a* are also flattened, or broadened, as shown at 12, in the region of the melt-seal to the cross element 7*a*, to provide protection against rotation of the struts.

The cross element 7*a*, preferably, is made of two quartz glass rods 7*a'*, 7*a"*, see FIG. 2, between which the support struts 8*a*, 9*a* and the holders 10*a* are located. To melt-connect the struts 8*a*, 9*a* and the holders 10*a*, the glass rods 7*a'* and 7*a"* are heated to softening temperature and then pressed together. After cooling, the glass rods 7*a'*, 7*a"* are melt connected together and form the cross element 7*a* with the support strut portions 8*a* and 9*a*, and the filament holders 10*a* melt-sealed therein.

The frame half 4*b* of the frame 4 is made in identical manner. The frame halves 4*a*, 4*b*, respectively, are made, entirely automated, in a rotating or turret rod framing, and pinch connecting machine.

In the next step, and to secure the filament, two pre-manufactured frame halves 4*a*, 4*b* are placed in a suitable jig—not shown—such that the cross elements 7*a*, 7*b* are positioned parallel to each other (see FIG. 3), and the free end of the long strut portion 8*a* of the first half 4*a* faces the free end of the short support strut portion 9*b* of the second frame half 4*b*. The free end of the short strut 9*a* of the first frame half 4*a* then will face the free end of the long strut portion 8*b* of the second frame half 4*b*. The filament 11 is then placed in the jig. The singly coiled ends 11*a*, 11*b* of the filament 11 are threaded on the longer support struts 8*a*, 8*b* of the respective halves 4*a*, 4*b*. The uncoiled portions of the filament 11 are hooked in the holders 10*a*, 10*b*.

The singly coiled portions of the filament 11 are then stretched by increasing the spacing of jig elements which, respectively, retain the frame halves 4*a*, 4*b*, that is, the spacing between the cross elements 7*a*, 7*b* is increased. Next, the two frame halves 4*a*, 4*b* are connected together by welding the flattened ends 13*a*, 14*a* of the respective support struts 8*b*, 9*b* and 9*a*, 8*a* together. The flattened end 13*a* of the longer support strut 8*a* of the first half 4*a* is connected with a flattened end of the shorter support strut 9*b* of the second half 4*b*. The flattened end 14*a* of the short strut 9*a* of the first frame half 4*a* is welded to the flattened end of the longer support strut 8*b* of the second frame half 4*b*. Laser welding or resistance welding is suitable. The ends of the filaments 11*a*, 11*b*, already threaded on the longer support struts 8*a*, 8*b*, are aligned and pressed on the respective support struts 8*a*, 8*b*. By passing electric current through the filament, the filaments are secured to the support struts 8*a*, 8*b* remote from the flattened ends 13*a*.

The ends of the support struts 8*a*, 9*a* which project upwardly (with respect to FIG. 1) of the cross element 7*a* are shortened by being cut. The ends of the support struts 9*b*, 8*b* projecting from the lower cross element 7*b* (see FIG. 3) are welded, respectively, to molybdenum foils 2, 3. The molybdenum foils are held in place and connected by a molybdenum wire 15. The result is a frame 4 for the lamp, as shown in FIG. 3. This frame is inserted in a pre-manufactured bulb 1 and aligned therein. The lamp bulb 1 is then, as well known and in the standard manner, sealed by pinch-sealing or press-sealing the end of the bulb about the molybdenum foils 2, 3, evacuated through an exhaust tube, and filled with a mixture of inert gas and a halogen. The U-shaped molybdenum wire 15 is severed after the gas-tight melt-sealing or pinch-sealing of the molybdenum foils 2, 3 in the base portion 1*a* of the lamp bulb, so that its projecting ends can form the current supply leads 5, 6 (FIG. 4). The bulb, with the projecting connecting wires, can then be secured in any suitable base, in accordance with well-known lamp manufacturing technology.

Various changes and modifications may be made within the scope of the inventive concept.

We claim:

1. A method to make an electrical incandescent lamp having a lamp bulb (1);

a filament (11);

a filament retention frame (4) to retain the filament in a pre-arranged position within the bulb, wherein the frame essentially comprises two rod or strip-shaped cross elements (7a, 7b) of electrical insulating material, two support strut portions, (8a, 8b; 9a, 9b) connecting and spacing said cross elements (7a, 7b) and at least one filament holder (10a, 10b) secured to each of said cross-elements (7a, 7b), said method including process steps to make the frame (4) and to thread the filament (11) on the frame, comprising, in accordance with the invention, the steps of providing two essentially identical frame halves (4a, 4b), wherein each half includes one of said cross-element (7a, 7b), two support strut portions (8a, 8b; 9a, 9b) secured to the respective cross element (7a, 7b), leaving free ends projecting therefrom, and at least one filament holder (10a, 10b) secured to the respective cross element (7a, 7b) between the support strut portions, to form a pre-assembled frame half (4a, 4b);

positioning said pre-assembled frame halves (4a, 4b), such that said cross elements (7a, 7b) are essentially parallel to each other, with free ends of the strut portions facing each other, and separated by a predetermined spacing;

threading one coiled end (11a) of the coiled filament on the free end of one (8a) of said strut portions of one of said frame halves;

threading the other end (11b) of the coiled filament on the free end of one of said strut portions (8b) of the other (4b) of the frame halves;

attaching intermediate portions of the coiled filament to said holders (10a, 10b);

increasing the spacing between said frame halves (4a, 4b), and thereby stretching said filament (11);

securely connecting together the support strut portions (8a, 9a) of a first frame half (4a) with the support strut portions (8b, 9b) of a second frame half (4b) to form connected frame halves, and thereby holding said filament (11) in stretched condition between said connected frame halves (4a, 4b) and forming said filament and retention frame (4); and positioning and attaching the ends (11a, 11b) of the filaments to the respective support strut portions (8a, 8b) on which they are threaded.

2. The method of claim 1, wherein said cross elements (7a, 7b) comprises quartz glass.

3. The method of claim 1, wherein said cross elements (7a, 7b) comprise a glass; and wherein the support strut portions (8a, 9a; 8b, 9b) of any one of said frame halves (4a, 4b) are melt-sealed in the cross element (7a, 7b) forming part of the respective frame half (4a, 4b).

4. The method of claim 3, wherein said glass comprises quartz glass.

5. The method of claim 1, wherein the support strut portions (8a, 9a; 8b, 9b) of any one of the frame halves have different lengths, and comprise a high temperature-resistant, high temperature-melting metal.

6. The method of claim 5, wherein said one end (11a) of the coiled filament is threaded on the longer (8a) support strut portion of the first frame half (4a), and the other coiled end (11b) of the filament is threaded on the longer (8b) support strut portion of the second frame half (4b).

7. The method of claim 5, wherein the longer support strut portion (8a) of the first frame half (4a) is securely connected to the shorter support strut portion (9b) of the second frame half; and the shorter support strut portion (9a) of the first frame half (4a) is securely connected to the longer support strut portion (8b) of the second frame half (4b).

8. The method of claim 6, wherein the longer support strut portion (8a) of the first frame half (4a) is securely connected to the shorter support strut portion (9b) of the second frame half; and the shorter support strut portion (9a) of the first frame half (4a) is securely connected to the longer support strut portion (8b) of the second frame half (4b).

9. The method of claim 7, wherein the facing ends of the support strut portions (8a, 8b; 9a, 9b) are flattened to define flattened ends (13a, 14a);

and wherein said securely attaching step comprises welding the flattened ends (13a, 14a) of the support strut portions together to form said support struts.

10. An electrical incandescent lamp having a lamp bulb (1);

a filament (11) within the lamp bulb;

a filament retention frame (4) to retain the filament in pre-arranged position within the bulb, which frame essentially comprises two rod or strip cross elements (7a, 7b) of electrically insulating material, two support strut portions (8a, 8b; 9a, 9b) connecting and spacing said elements (7a, 7b), and at least one filament holder (10a, 10b) secured to each of said cross elements (7a, 7b) and retaining the filament in stretched condition between said cross elements, wherein, in accordance with the invention, said frame comprises two pre-assembled, and weld-connected frame halves (4a, 4b), said frame halves being essentially identical and comprising, each, one of said cross elements (7a, 7b), two strut portions (8a, 9a, 9b, 8b), each melt-sealed into the respective cross element, the respective support strut portions of the respective frame halves being welded together to form a holder frame for said filament (11).

11. The lamp of claim 10, wherein a plurality of filament holders (10a, 10b) are weld-connected to the respective cross elements (7a, 7b), and said filament (11) is secured in meander form to said holders to form an essentially plane filament structure.

12. The lamp of claim 10, wherein the support strut portions (8a, 9a; 8b, 9b) of the respective frame halves (4a, 4b) are of different lengths; and wherein the longer one of the support strut portions of one frame half has a weld connection with the shorter one of the support strut portion of the other frame half.

13. The lamp of claim 12, wherein end portions (11a, 11b) of the filament (11) are threaded on, and connected to, the longer one (8a, 8b) of the support strut portions at a position remote from the weld connection of the respective support strut portions of the frame halves.

* * * * *